US006672748B2

(12) United States Patent
Baldwin

(10) Patent No.: US 6,672,748 B2
(45) Date of Patent: Jan. 6, 2004

(54) BACK LIGHTED DISPLAY UNIT

(76) Inventor: Eric Dean Baldwin, 2390 McGowan Blvd., Marion, IA (US) 52302

( * ) Notice: Subject to any disclaimer, the term of this patent is extended or adjusted under 35 U.S.C. 154(b) by 81 days.

(21) Appl. No.: 09/681,097

(22) Filed: Jan. 4, 2001

(65) Prior Publication Data

US 2001/0030878 A1 Oct. 18, 2001

Related U.S. Application Data

(60) Provisional application No. 60/174,625, filed on Jan. 5, 2000.

(51) Int. Cl.[7] ..... F21V 11/00

(52) U.S. Cl. ..... 362/558; 362/31; 362/222; 362/26; 362/812; 362/84; 362/559

(58) Field of Search ..... 362/558, 31, 222, 362/26, 812, 97, 84, 554, 559; 40/546, 716, 544

(56) References Cited

U.S. PATENT DOCUMENTS

| | | | | | |
|---|---|---|---|---|---|
| 2,557,383 | A | | 6/1951 | Kerwer | |
| 3,783,544 | A | * | 1/1974 | Brody | 40/616 |
| 4,264,979 | A | | 4/1981 | Gutowski | |
| 4,443,832 | A | | 4/1984 | Kanamori et al. | |
| 4,574,269 | A | * | 3/1986 | Miller | 362/503 |
| 4,709,307 | A | | 11/1987 | Branom | |
| 5,005,108 | A | | 4/1991 | Pristash et al. | |
| 5,136,480 | A | | 8/1992 | Pristash et al. | |
| 5,471,773 | A | * | 12/1995 | Hoffman | 40/544 |
| 5,546,687 | A | * | 8/1996 | Burns et al. | 40/546 |
| 5,636,914 | A | * | 6/1997 | Trusiani | 362/26 |

* cited by examiner

*Primary Examiner*—Stephen Husar
*Assistant Examiner*—Bertrand Zeade
(74) *Attorney, Agent, or Firm*—James C. Nemmers

(57) ABSTRACT

An illuminated back-lighted display unit that is capable of displaying a variety of different types of artwork, messages, logos, or pictures in various applications within a home, commercial building, vehicle, or anywhere a miniature back-lighted display is desired. The display unit has a main housing which contains a light source that may include a diffuser and a cover lens or glass that includes one or more layers of the artwork to be displayed. The cover glass is trimmed with a trim bezel, and when assembled, the unit is provided with some means of mounting the assembly to the window or other structure through which it will be viewed.

3 Claims, 4 Drawing Sheets

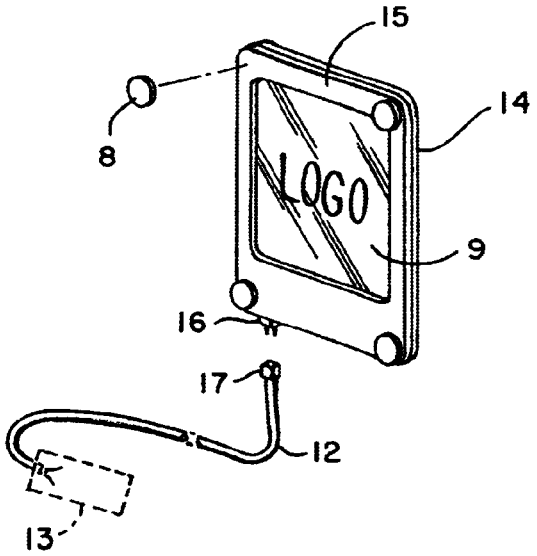
FIG. 1
FIG. 2
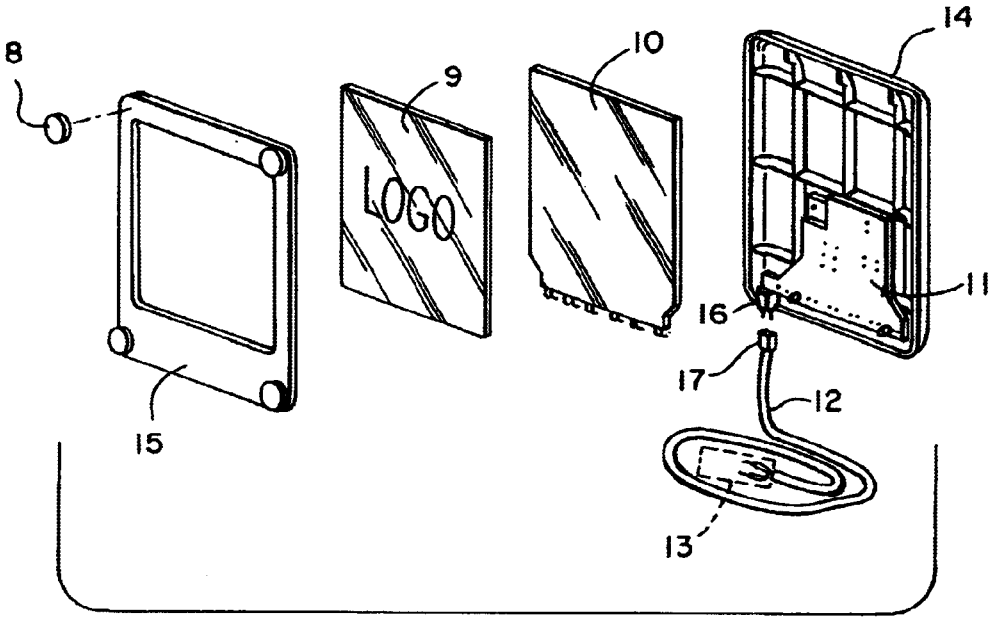

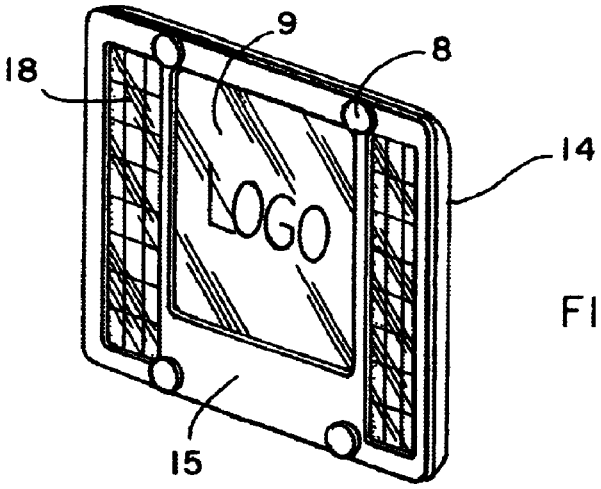
FIG. 6
FIG. 7
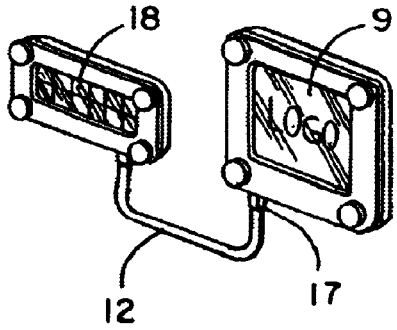
FIG. 8
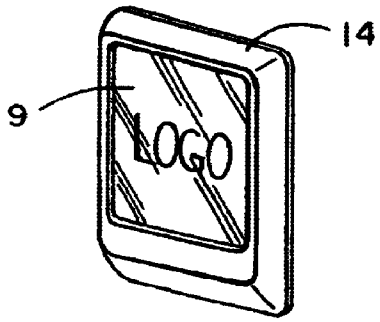
FIG. 9
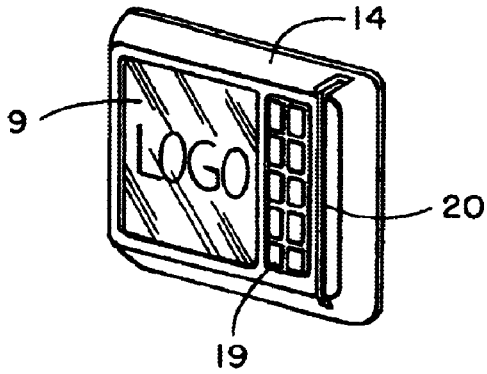

FIG. 10
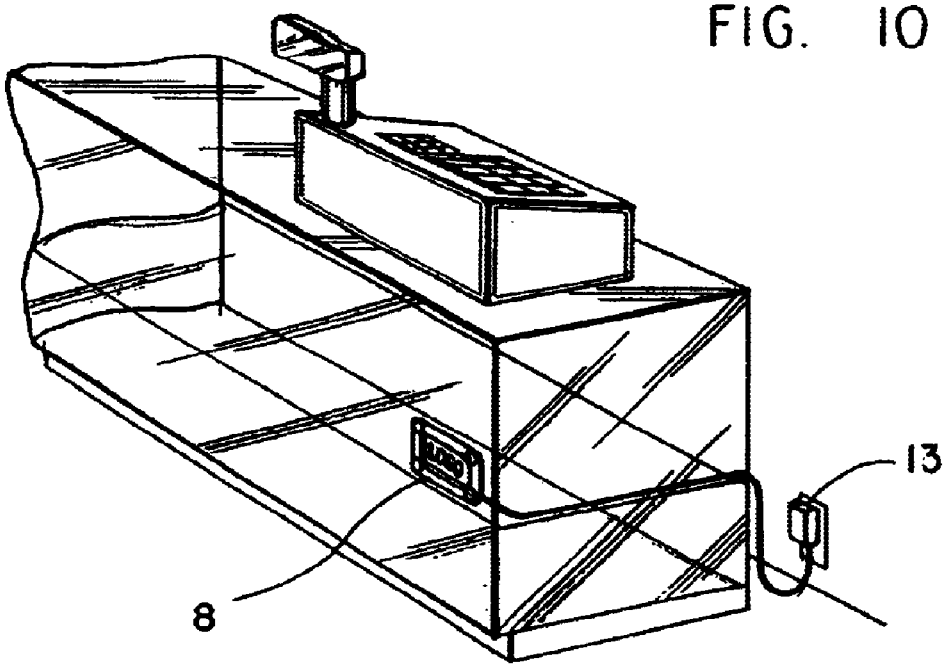
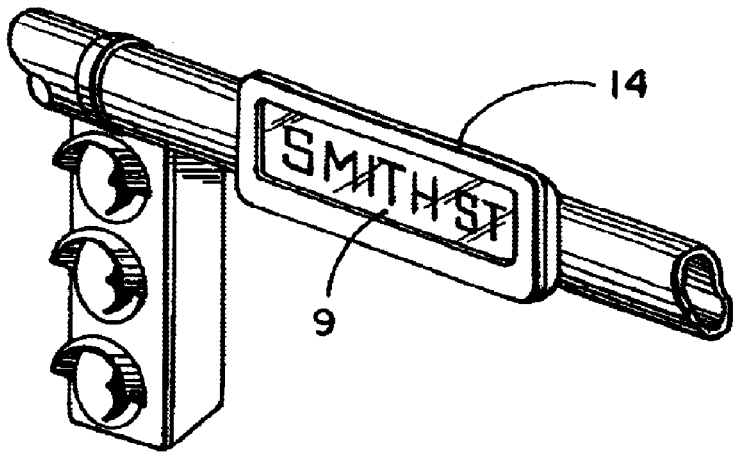
FIG. 11

BACK LIGHTED DISPLAY UNIT

BACKGROUND OF INVENTION

1. Field of the Invention

The present invention relates to illuminated displays, and more particularly pertains to a unit for illuminating artwork such as a logo, icon, or brand name.

2. Description of the Prior Art

Various types of illuminated displays are known in the prior art. A typical example of such an illuminated display is to be found in U.S. Pat. No. 2,557,383, which issued to F. Kerwer on Jun. 19, 1951. This patent discloses a balloon provided with a plurality of spaced sockets to form various illuminated display signs. U.S. Pat. No. 4,264,979, which issued to K. Gutowski on Apr. 28, 1981, discloses an illuminated display for mounting adjacent a vehicle window. The display is connected to a CB transceiver and identifies the operator and channel in use. U.S. Pat. No. 4,443,832, which issued to H. Kanamori et al on Apr. 17, 1984, discloses a self-illuminating ornament for attachment to a vehicle body to indicate a manufacturer's mark. U.S. Pat. No. 4,574,269, which issued to G. Miller on Mar. 4, 1986, discloses a visual communication display adapted for mounting adjacent a rear window of a vehicle. This display unit includes a plurality of light emitting diodes in a matrix arrangement, which may be selectively energized to display various messages. U.S. Pat. No. 4,709,307, which issued to D. Branom on Nov. 24, 1987, discloses an article of clothing provided with an illuminated display. A set of light emitting diodes are mounted in a substrate and provided with a portable power source.

While the above-mentioned patents are directed to illuminated displays, none of the display units disclosed in them are suitable for mounting on the interior of a window or other glass surface, such as in a vehicle, nor are they suitable for illuminating a logo, icon, picture, etc. with a high intensity and durable light source. Inasmuch as the prior art is relatively crowded with respect to these various types of illuminated displays, it can be appreciated that there is a continuing need for and interest in improvements to such illuminated displays, and in this respect, the present invention addresses this need and interest.

It is therefore an object of the present invention to provide an illuminated back-lighted display unit which overcomes the disadvantages of the prior art illuminated displays.

It is another object of the present invention to provide an illuminated backlighted display unit of a higher intensity and which may be easily and efficiently manufactured and marketed.

It is a further object of the present invention to provide an illuminated backlighted display unit which is of a durable and reliable construction.

Yet another object of this invention is to provide an illuminated back-lighted display unit that allows for a plurality of different mountings for use in a variety of applications.

These and other various objects of the invention will become apparent from the accompanying drawings and detailed description in which there are illustrated the preferred embodiments of the invention.

SUMMARY OF INVENTION

The invention provides an improved illuminated back-lighted display unit that is capable of displaying a variety of different types of artwork, messages, logos, or pictures in various applications within a home, commercial building, vehicle, or anywhere a miniature back-lighted display is desired. The display unit of the invention includes a main chassis or enclosure which houses a high intensity light source that may include a diffuser and a cover lens or glass that covers one or more layers of the artwork to be displayed. The cover glass is trimmed with a trim bezel, and the components are held together in any suitable manner. When assembled, the unit is provided with some suitable means of mounting the assembly to the window or other structure through which it will be viewed.

BRIEF DESCRIPTION OF DRAWINGS

The invention will be better understood and objects, other that those set forth above, will become apparent when consideration is given to the following detailed description which description makes reference to the accompanying drawings in which:

FIG. 1 is a perspective view illustrating an assembled illuminated back-lighted display unit constructed according to the principles of the invention;

FIG. 2 is an exploded view of the display unit of FIG. 1 showing the essential components that make up the unit;

FIG. 6 is a perspective view of another embodiment of the invention showing a display unit combined with a solar collector;

FIG. 7 is a perspective view of another embodiment of the invention showing a display unit combined with a solar collector that is an independent unit;

FIG. 8 is a perspective view of yet another embodiment of the invention showing the display unit modified for mounting externally of the mounting surface;

FIG. 9 is a view similar to FIG. 8 and illustrating the addition of a key pad and/or magnetic card reader;

FIG. 10 is a perspective view showing the display unit of the invention as mounted in a transparent display case; and FIG. 11 is a perspective view showing the display unit of the invention used to illuminate street name signs.

DETAILED DESCRIPTION

Figure 3A:
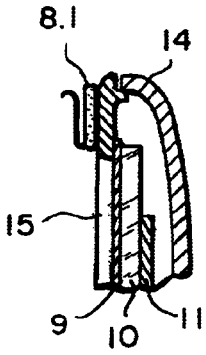
FIGS. 3A, 3B and 3C are detailed views, partly in section, illustrating different ways of mounting the display unit of FIG. 1.

There has thus been outlined, rather broadly, the more important features of the invention in order that the detailed description that follows may be better understood, and in order that the present contribution to the art may be better appreciated. It is to be understood that the invention is not limited in its application to the details of construction and to the arrangements of the components set fourth in the following description or illustrated in the drawings. The invention is capable of other embodiments and of being practiced and carried out in various ways. Also, it is to be understood that the phraseology and terminology employed herein are for the purpose of description and should not be regarded as limiting.

With reference now to the drawings, and in particular to FIGS. 1 and 2, an illuminated back-lighted display unit, embodying the principles and concepts of the present invention, will be described.

The unit of the invention includes a chassis or housing 14 to which is connected a power cord 12 for connection of the unit to a suitable power source 13, such as a 110 VAC source commonly found in homes and businesses, a 12 volt power source commonly found in security systems for homes and businesses, a 12 volt power source of an automobile or other vehicle, solar collector panels or to self-contained batteries. FIGS. 6 and 7 illustrate units in which there has been incorporated a solar collector panel 18 which is used as the power source which would eliminate the use of a power cord 12. FIG. 6 shows the solar collector panel 18 an integral part of the housing 14 while FIG. 7 shows the panel 18 as a separate unit connection to the display unit by a power cord 12. It will be understood by those skilled in the art that the power source options which require a power cord 12 will also require a suitable connector (not shown) at the end of the power cord 12 to permit connection of the power cord 12 to a 110 VAC outlet plate in the home or business or will require an adapter plug to provide for connection to a 12-volt outlet in a vehicle. The power cord 12 may include mating connectors 16 and 17 to provide for quick disconnect from the housing 14.

As best seen in FIG. 2, the housing 14 contains the electronics 11 which may include the input power voltage/current regulator and the function/photo eye (light) circuitry. The housing 14 also houses the light source 10, which may be incandescent lamps, LEDs, fiber optics, electroluminescent or any other suitable source. For example, the light source 10 can be either: a thin film of electroluminescent material with its associated electronics or a fiber-optic bundle. Preferably, the light source 10 is a solid translucent/transparent thin panel illuminator such as one made by Lumitex® which it marketed under the name Solid State and which provides a high intensity and very durable light source. This type of illuminator is shown in U.S. Pat. Nos. 5,005,108 and 5,136,480. It will be understood that such electronics and light sources are obvious to those skilled in the art and therefore they are not described in detail herein. The translucent panel or cover glass 9 on which the artwork can be applied is positioned ahead of the light source 10, and the trim bezel 15 completes the assembly of the unit. The artwork being illuminated can be applied to the viewing surface of the cover glass 9 by either: 1) applying it in the form of a sticker or static cling decal, or 2) applying the artwork via various printing processes, or the entire unit can be used without artwork to illuminate an existing window display. The cover glass 9 may be permanently secured to the housing or made to be removable and interchangeable. The cover glass 9 is preferably a plexiglas or acrylic sheet and may be made up of several layers of diffusers and/or transparent sheets that provide protection or enhancement for the artwork being displayed. The material used for and layering of the cover glass 9 may also be designed for structural reasons. Assembly of the component parts into a finished unit can be achieved through the use of an adhesive product, by sonic welding, by mechanically interlocking (snapping) the parts together, or by other suitable fastening means.

Suitable mounting means 8 are attached to the trim bezel 15. The mounting means 8 are preferably small pieces or a continuous gasket of foam 8.1 having adhesive on both sides of the foam (FIG. 3A) so that one side adheres to the unit and the other side adheres to the window to which the unit is mounted. Another method for attachment is shown in FIG. 3B which illustrates the use of suction cups 8.2 that are permanently attached to the perimeter of the trim bezel 15. A third mounting option is the use of an adhesive backed hook and loop product 8.3 (FIG. 3C) such as Velcro®.

Figure 3B:
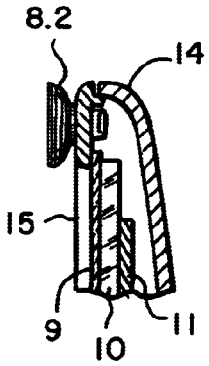
Figure 3C:
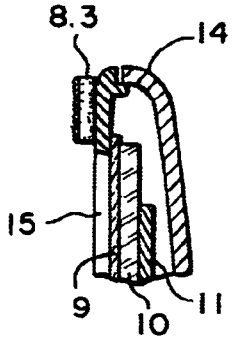
Figure 4:
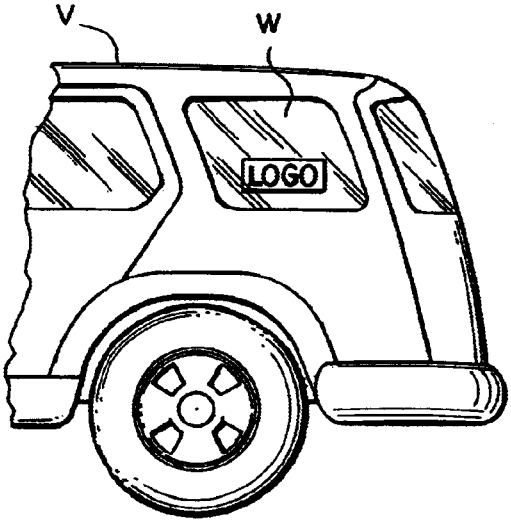
FIG. 4 is side elevational view illustrating the display unit of the invention mounted within the interior of a vehicle.
Figure 5:
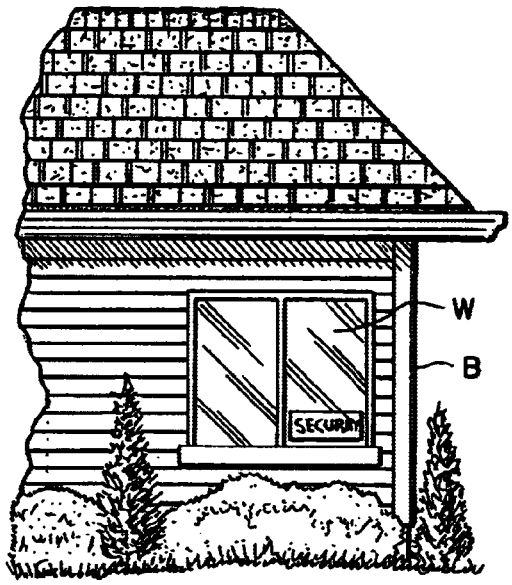
FIG. 5 is an elevational view illustrating the display unit of the invention mounted within the interior of a building.

FIG. 4 shows the unit mounted to the interior side of a window W on a vehicle V using any of the mounting means illustrated in FIG. 3. FIG. 5 shows the unit mounted to the interior side of a window W of a home or commercial building B, again attached through any of the means illustrated in FIGS. 3A, 3B and 3C, while FIG. 10 shows the unit mounted on the interior or a display case using suction cups 8.2.

FIG. 8 shows an embodiment of the display unit in which the housing 74 is reversed so that the unit can be mounted using suitable mounting means (similar to those of FIGS. 8A, 8B and 8C) on the same side of a surface from which it is being viewed. FIG. 11 shows such a use for illuminating street signs, for example. FIG. 9 shows yet another embodiment of the invention in which the unit includes a keypad 19 and/or a slot 20 for a magnetic card reader that is built into the unit. This unit can therefore be used in security applications, for example, where it is desired to display some information, such as a business name or logo, and then require a code or password to allow entry to a secure place.

Having thus described the invention in connection with preferred embodiments thereof, it will be evident to those skilled in the art that the optimum dimensional relationships for the parts of the invention, including variations on size, materials, shape, form, function and manner of operation, and all equivalent relationships to those illustrated in the drawings and described in the specification are intended to be encompassed by the present invention. For example, the outside configuration of the display unit, although shown as flat and rectangular, may be square, round, oval or any other shape, including a custom profile of the actual artwork being displayed. Also, the unit may be rigid and shaped to fit a convex, rounded or other surface to which it will be attached or the unit may be flexible to conform to an irregular mounting surface. The invention has many applications in addition to those shown in the drawings. For example, the display unit can be used to for display cases in point of sale application, and street and highway signs. Thus, the artwork being displayed may be a name, logo, advertisement, etc.

Therefore, the foregoing disclosure is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to that fall within the scope of the invention as defined in the following claims. It is also important that the claims be regarded as including such equivalent constructions insofar as they do not depart from the spirit and scope of the present invention.

What is claimed is:

1. An illuminated back-lighted display unit for displaying artwork, said unit comprising: a main housing having a front and rear and side edges that define a open area within the housing; a light source combined with the front of the main housing, said light source comprising a solid thin light source panel illuminated by a plurality of light emitting diodes that provide a high intensity and diffused white light source, the light source panel extending across substantially the entire open area of the housing; a power source connector combined with the light source panel to supply power to the light source; further comprising a removable and interchangeable translucent panel having a front surface and a rear surface positioned in the housing in front of the light source panel and extending across substantially the entire open area of the housing so that the light from the light source panel is transmitted through and diffused by the translucent panel, art work positioned on the front surface of the translucent panel so that the artwork is illuminated by the light being transmitted through the translucent panel from the light source panel; a retainer for retaining the translucent panel in the housing in front of the light source panel; and a mounting for attaching the unit to a desired location.

2. The illuminated back-lighted display unit of claim 1 in which the mounting is attached to the front of the main housing and includes one or more suction cups sides to provide for attaching the unit to a transparent structure.

3. The illuminated back-lighted display unit of claim 1 in which the mounting is attached to the front of the main housing and includes a gasket having front and rear sides and adhesive on both front and rear sides to provide for attaching the unit to a transparent structure.

* * * * *